US006004252A

United States Patent [19]

Blaser

[11] Patent Number: 6,004,252

[45] Date of Patent: Dec. 21, 1999

[54] BAG MAKING APPARATUS AND METHOD FOR MAKING PLASTIC BAGS INCLUDING A WICKET TRANSFER UNIT AND WICKET CONVEYOR

[75] Inventor: Giles R. Blaser, Green Bay, Wis.

[73] Assignee: Amplas, Inc., Green Bay, Wis.

[21] Appl. No.: 08/799,170

[22] Filed: Feb. 14, 1997

[51] Int. Cl.[6] ..... B31B 1/64; B31B 49/04

[52] U.S. Cl. ..... 493/204; 493/3; 493/29; 493/186; 493/231

[58] Field of Search ..... 493/186, 204, 493/3, 8, 27, 29, 194, 195, 196, 231

[56] References Cited

U.S. PATENT DOCUMENTS

| | | | |
|---|---|---|---|
| 3,431,828 | 3/1969 | Crawford et al. | 93/13 |
| 3,722,560 | 3/1973 | Morine et al. | 198/19 |
| 4,073,041 | 2/1978 | Davis et al. | 198/339 |
| 4,231,558 | 11/1980 | Aterianus et al. | 493/186 |
| 4,371,365 | 2/1983 | Shingo | 493/25 |
| 4,451,249 | 5/1984 | deBin | 493/204 |
| 4,735,602 | 4/1988 | De Bin | 493/204 |
| 5,000,727 | 3/1991 | Hatchell | 493/194 |
| 5,041,070 | 8/1991 | Blaser | 493/14 |
| 5,338,281 | 8/1994 | Terranova | 493/28 |
| 5,746,569 | 5/1998 | Smith et al. | 493/196 |

OTHER PUBLICATIONS

Stiegler GmbH, Maschinenfabrik Germany, Universal Sealing Machine U900W.

*Primary Examiner*—Eugene L. Kim

*Attorney, Agent, or Firm*—Andrus, Sceales, Starke & Sawall

[57] ABSTRACT

A bag forming machine includes draw rolls for drawing a folded plastic web to and through a cut and seal unit for forming of successive bags. A wicketer receives the individual bags and rotates to carry successive bags to an opposite discharge end and depositing of the bags onto a pin stacker. A wicket conveyor includes an endless chain with an input sprocket adjacent the discharge end of the wicketer and a discharge sprocket located in spaced alignment to a discharge end of the conveyor. A plurality of pin stackers are secured in equi-spaced relation to the chain. A high response AC servo motor located at the input end of the conveyor is connected via a chain to the input sprocket. An independent servo controller is connected to energize the AC servo motor. A multi-axis servo controller is connected to servo drives for operating servo motors connected to the draw roll, the cut and seal unit, and the wicketer. The independent high response motor and dedicated servo controller can replace the independent motor drive systems of conveyors in existing bag lines. The conveyor is a compact unit for forming compact lines which can be formed in a plurality of side-by-side lines. The web supply is L-shaped with a vertical V-folder and formed as a compact unit which in combination with the conveyor permits forming adjacent bag lines with a reduced footprint.

22 Claims, 7 Drawing Sheets

FIG. 6
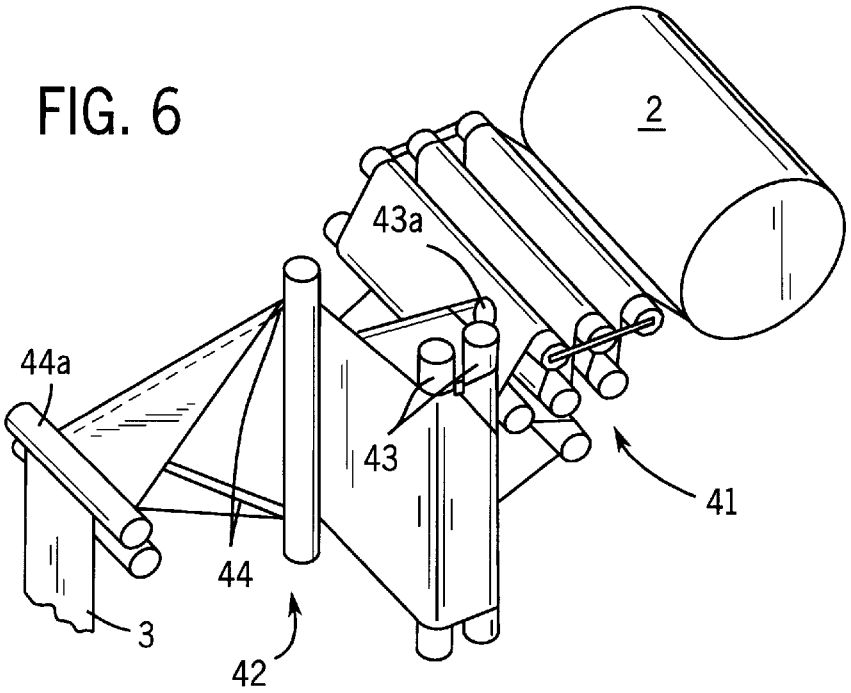
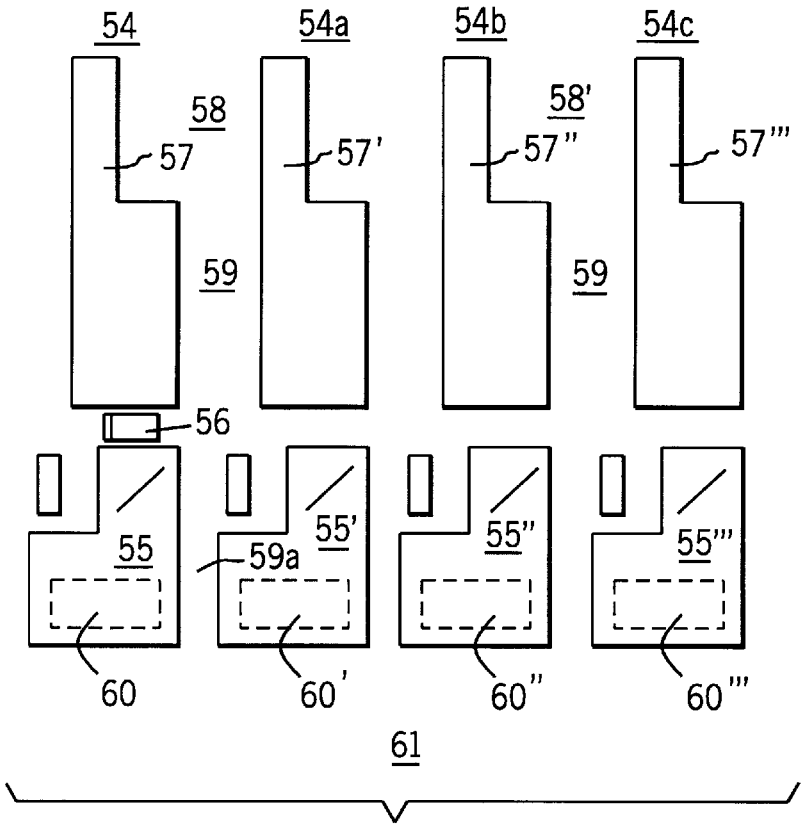
FIG. 7

BAG MAKING APPARATUS AND METHOD FOR MAKING PLASTIC BAGS INCLUDING A WICKET TRANSFER UNIT AND WICKET CONVEYOR

BACKGROUND OF THE INVENTION

Plastic bags are presently manufactured by continuous movement of a tubular or folded plastic web through a bag making machine or apparatus. The web is generally stored in a large supply roll of a flat film and is drawn and folded under controlled tension, usually through driven draw rolls of the bag machine apparatus. A cut and seal unit is mounted downstream of the draw rolls and severs the folded web transversely to form a series of bags of a selected or standard length. A transfer unit, often in the form of a wicketer, is provided for transfer of the bags to a wicket stacking unit or device. The wicketer includes a plurality of circumferentially spaced vacuum arms secured to a rotating device or support. The bag from the cut and seal unit is held to an arm which rotates from an input side to a discharge side and deposits the bags on the stacking device. A widely used stacking device includes an endless wicket conveyor with a motor and drive connected at the outlet end. Pin stacker units are secured to an endless stacker support member in spaced relation for selective positioning between the input end of the conveyor and the output or discharge end of the conveyor. The conveyor input end aligns a pin stacker unit with the movement of the wicket arms at the discharge side of the wicketer. As each arm moves past the pin stacker, the bag is deposited onto the pins of the pin stacker. The bag is formed with one or more appropriately spaced openings which are aligned with the pin or pins on the pin stacker.

Generally, each bag stack will have a selected number of bags to produce a "filled" pin stacker. The conveyor is operated to remove the filled stacker and move a new pin stacker automatically aligned with the discharge side of the wicketer. Movement of the filled stacker requires a greater period of time than that required for the movement of adjacent vacuum arms into an aligned position. Historically, the bag forming portion of the line is interrupted to allow movement of one or more interrupt cycles and empty vacuum arms move through the input end of the conveyor and allow the movement of the succeeding or new stacker element into position to receive the bags from the arms following the interrupt arms. In this manner, an essentially continuous operation of the bag making machine or apparatus provides for sequential forming and accumulation of stacks of corresponding bags. Each stack, of course, is discharged or removed at the discharge and output end of the conveyor, either through an automatic or manual removal system.

The bag making machinery or apparatus is operated at a maximum operating speed permitted by the several components to produce a most cost effective forming of the bags. Obviously, the required time for repositioning of a filled pin stacker and replacement with a new pin stacker may be a limiting factor in the total overall production of bags per unit of time.

Chain driven conveyors have generally been used in the wicket conveyor. Stacking platforms are secured to the chain in longitudinally spaced relation, with the pins adjustably secured to the platform to accommodate different forms of bags. A preferred construction is shown in the pending patent application assigned to a common assignee and entitled "Bag Forming Machine Having Adjustable Support Structure For Paired Work Elements", inventor Michael J. Smith et al with Ser. No. 08/600,341 and filed Feb. 13, 1996. An independent drive unit is secured to the discharge and output end of the conveyor chain drive and operated in time spaced relation through a timing control associated with the interruption of the bag forming part of the machine. In the prior art wicketing conveyor, the conveyor chain drive is mounted in a slide support for positioning the pin stackers in bag receiving alignment. The drive unit includes a geared adjustment motor and positioning coupling for moving the complete chain unit for such alignment positioning and is a relatively large unit at the outer end of the conveyor. In this conveyor drive system, the conveyor chain unit is pulled forwardly and must be concerned with the slack of the unit and over shooting and/or oscillating thereof.

Historically, the independent drive motor is secured to the discharge end of the conveyor and the initiation of the conveyor motor operation is controlled from a control system which also actuates the bag forming machine. Thus, the draw rolls for moving of the web is operated in an intermittent and interrupted manner and is controlled to stop movement of the web during selected movement of the wicketer to allow transfer of one or more empty wicketer arms through and to the conveyor. For example, for many years a logic controller was connected through a clutch and brake control for actuating of the draw roll drive. The timing control was established through a main drive shaft driven from an AC drive motor. A cam unit coupled the main drive shaft to the cut and seal unit and a programmable limit switch provided a reference source for controlling of the draw rolls and the wicket conveyor. Thus, the output of the drive shaft provided a cycle control. Each 360° rotation of the drive shaft created one cycle of the bag forming machine. The web was drawn by the draw rolls into appropriate alignment with the seal and cut unit. Movement of the draw rolls was then interrupted momentarily to allow the seal and cut unit to sever the web and produce a bag which was discharged to a wicketer for transfer to a wicket conveyor. A stack count was generated by this cyclical operation. A logic controller included a plurality of registers, one of which provided an interrupt count and a second provided a delay count. When the stack count indicated that the number of bags equal to a stack had been formed, the bag forming machine was signaled for interrupt operation for the necessary time for the transfer unit to transfer formed bags to the stacker and allow insertion of a new stacker. An interrupt count was set to create empty wicket arms of a sufficient number and period to allow the operation of the wicket conveyor through a separate, independent drive. A signal was sent to the conveyor motor drive after an appropriate time delay as set by the second register to allow the transfer of all formed bags to the stacker and then to initiate the cycle of wicket conveyor during movement of the bag-free arms past the input end of the conveyor. A photocell unit, or other as sensor, may be coupled to the input end of the wicket conveyor as in the prior art and generate pulse signals which would detect a jammed condition and also provide the signals to the conveyor register. The independent conveyor motor drive once started, included a self-controlled cycle with an index complete limit switch controlling the distance of movement of the wicket conveyor to move the new pin stacker into alignment as well as the time within the indexing cycle at which the motor starts to synchronize the conveyor for arrival one or more empty arms, at which time the cycle would repeat.

With the development of the servo motors, and particularly AC servo motors, various drives for the draw rolls, the seal unit and the wicketer and the conveyor had been developed and applied.

For a number of years, the assignee of this invention has manufactured and sold machines using a logic control system with AC servo motors for operation of the various components of the bag forming machine and wicketer. In each instance, an independent motor drive for operating of the wicket conveyor was provided to allow and maintain operating control. A jam detector which develops a pulse per bag movement, was also used, not only for detecting jams, but to synchronize the conveyor indexing with the operation of the draw rolls. Thus, the system allowed the usual drive of a counter register of the control system from the a pulse generator coupled to a main drive shaft or from the jam detector to initiate the new cycle of the draw rolls. In this system, a register is provided to delay the operation of the independent conveyor motor, at which time a signal was sent to a starting relay which initiated the starting of the independent motor drive, which then completed its cycle. The assignee has used a multi-axis servo controller for operating of the draw roll, the seal and cut unit and the vacuum wicketer. Registers were then driven from the main pulse source or from the jam detector sensor. The one register incremented to count the interrupt cycles. The second register incremented a preset number of cycles to initiate the operation of the independent motor drive for the wicket conveyor. In a typical operation of a six armed vacuum unit, three cycles were counted prior to beginning indexing of the wicket conveyor to allow transfer of the three last formed bags created after interruption of the bag forming machine or apparatus.

U.S. Pat. No. 5,338,281, which issued Aug. 16, 1994, discloses a single multi-axis servo-controller for operating of all of the components of a bag line including the wicket conveyor. The single controller controls the draw rolls and the conveyor including initiation and termination thereof as well as each component of the system.

There is a continuing need for a system to provide accurate and rapid positioning of the wicket conveyor for alignment of the pin stackers for receiving the bags. A more compact bag line adapted to multiple lines system is desirable.

SUMMARY OF THE PRESENT INVENTION

Generally, in accordance with the present invention, a high performance and responsive motor hereinafter referred to as a high response motor, and particularly such as an AC servo motor, operates the wicket conveyor of the bag line. The motor is coupled to the input end of an endless movable member to which the pin stackers are secured for positioning in sequence the plurality of pin stackers at the input end to receive the bags.

The elongated movable member of the conveyor is supported for movement in a vertical orientation or plane by a suitable rotatable support unit or assembly, generally including a plurality of spaced rotating members in a preferred construction. In a practical system, a chain-like member is supported by sprockets at the input end and the output end and at an intermediate location. The highly responsive motor is coupled to the rotating member at the input end and includes an inelastic or incompliant coupling such as a timing belt assembly. The motor generally includes a gear reducer for producing rapid and accurate positioning of the elongated member and the pin stackers with a commercially available servo motor.

A servo controller forming a part of an independent conveyor drive system is dedicated to and separably controls the wicket conveyor in a preferred construction. The other elements or components of the web supply, the bag forming machine and the wicketer are interconnected such as by a separate multi-axis controller, or other control system permitting high speed operation of the bag making machine and wicketer in the bag line. In a preferred embodiment, the multi-axis servo-controller includes three registers. One register accumulates the stack count and the index complete pulse, such as generated through the use of the main drive shaft operating a seal and cut unit and an enabler, an interrupt register and an conveyor index or start register. The index register counts cycle pulses from either a programmable switch coupled to the main cycle count source or from a jam detector unit at the input end of the conveyor and coupled to the index register as in the prior system of the assignee. As in the prior systems, the index count register again counts to allow the transfer of the final bags on the arms of the wicket conveyor to the existing aligned stacker. At the appropriate transfer count, a signal is sent to the start relay which signals the separate conveyor control such as the separate servo controller to operate and initiate the conveyor index cycle and the conveyor motor. A conveyor encoder coupled to the conveyor motor provides a feedback signal and establishes the independent positioning of the wicket conveyor in accordance with the individual programming thereof.

The system preferably includes a common touch screen coupled to the respective servo controllers for independently programming of the servo controllers and providing the desired timed control movement as set by the operator. The component drive system operates in accordance with applicant's prior developments, with the improvement in the conveyor connection of the motor at the input end of the wicket conveyor, preferably in combination with the independent conveyor motor control.

The high response motor connected at the input end, in addition to creating a desired high speed and accurate placement of the stackers, also provides a more compact conveyor unit. The conveyor is also conveniently adapted to unloading of the stackers from either side of the conveyor. The inventor has further designed a more compact bag line including the conveyor, including the compact conveyor unit, a generally L-shaped web supply assembly and a movable component cabinet in the bag line. The compact bag line is particularly adapted to assembling a plurality of side-by-side bag lines in a significantly smaller floor area for producing of bags, with the unloading of adjacent lines within a common adjacent area.

The present invention has been found to provide a cost effective and reliable system for high speed forming and stacking of bags.

BRIEF DESCRIPTION OF THE SEVERAL VIEWS OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 6 is a pictorial view of a web supply unit;

FIG. 7 is a diagrammatic view of a plurality of bag lines constructed in accordance with one aspect of the invention.

DETAILED DESCRIPTION OF THE ILLUSTRATED EMBODIMENT

Figure 1:
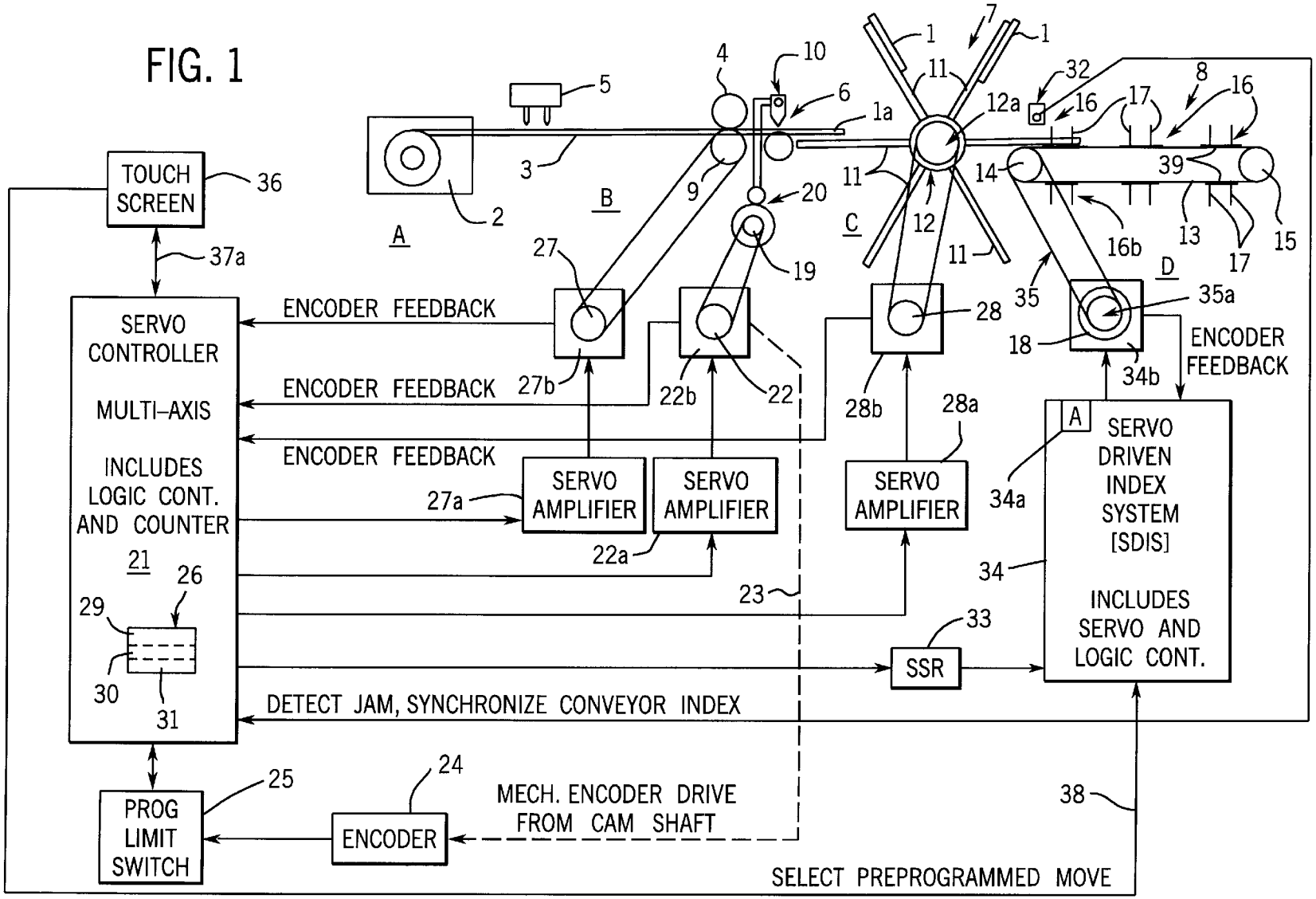
FIG. 1 is a schematic illustration of a bag forming machine in a preferred embodiment of the present invention.

Referring to the drawings, and particularly to FIG. 1, a bag forming line is illustrated including four main sections identified as a web supply section A, a bag forming section B, a bag transfer section C and a bag stacking section D connected to form an elongated bag line. The bag forming section B includes a bag machine which forms a series of bags 1 from a web supply roll 2 of section A providing a continuous plastic web 3. A set of draw rolls 4 of the bag machine grasps and pulls the web 3 from the supply section A. Cyclical operation of the draw rolls 4 creates a stepped movement of the web 3, with a dwell period and web move period. Suitable tension control devices are incorporated within the supply section and the bag forming section to provide for the smooth stepped movement of the web 3. A punch unit 5 located upstream of the draw rolls 4, forms spaced openings in the web at the edge of each bag to be formed. Punch unit 5 includes suitable pins which are periodically and in proper timed relation forced downwardly through the aligned edge of web 3, during the dwell period in which the web is momentarily stationary. The draw rolls 4 move the web in a stepped and cyclical motion into and through the punch unit 5 and a seal and cut unit 6 to form a bag 1. The bag 1 is transferred by a wicket unit 7 hereinafter identified as a wicketer to a wicket conveyor 8 wherein the bags are stacked as hereinafter described for subsequent transfer and positioning. Each of the components is generally constructed in accordance with known construction and are only briefly described, except as necessary to fully describe the preferred construction in accordance with the present invention.

The draw rolls 4 include at least one driven roll, shown as the bottom roll 9. The rolls 4 firmly move the web from the supply into and between the punch unit 5 and the cut and seal unit 6, and then enter the dwell period. The punch unit 5 and cut and seal unit 6, which includes a movable heated blade 10 for sealing and severing of the leading portion of the web 3, are actuated and form a bag la, with the punched openings or holes, not shown.

The wicketer 7, in accordance with a known construction, includes a plurality of circumferentially spaced vacuum arms 11 connected to a rotating support 12. A vacuum is supplied to the arms through the support 12 and hold the aligned bag la to the wicket arm 11. The arm rotation transfers the bag la from the input side adjacent to the cut/seal unit 6 to the input end of the wicket conveyor 8.

Figure 3:
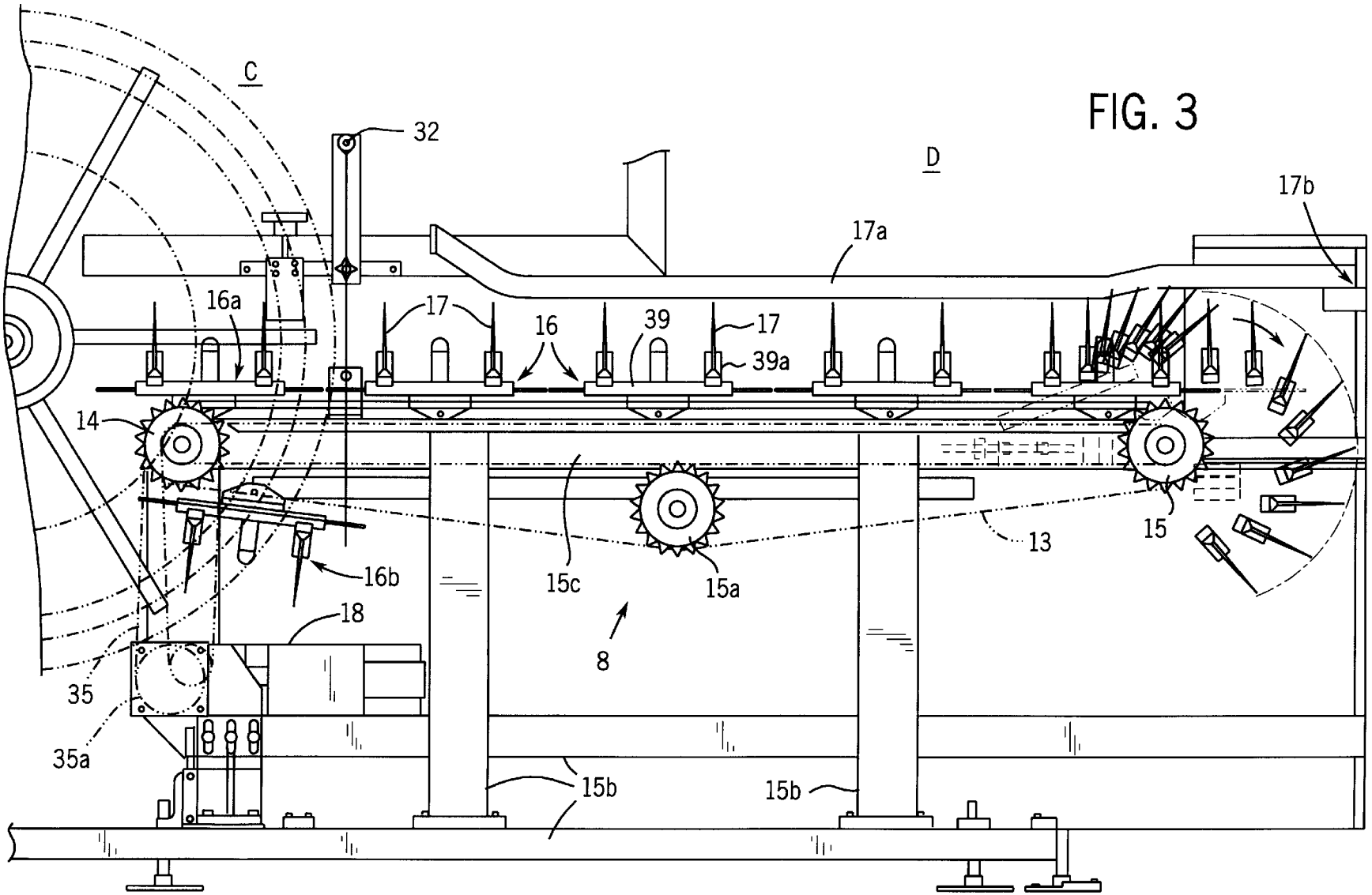
FIG. 3 is an enlarged view illustrating the preferred construction of a wicket conveyor and the drive as shown in FIGS. 1 and 2.
Figure 3A:
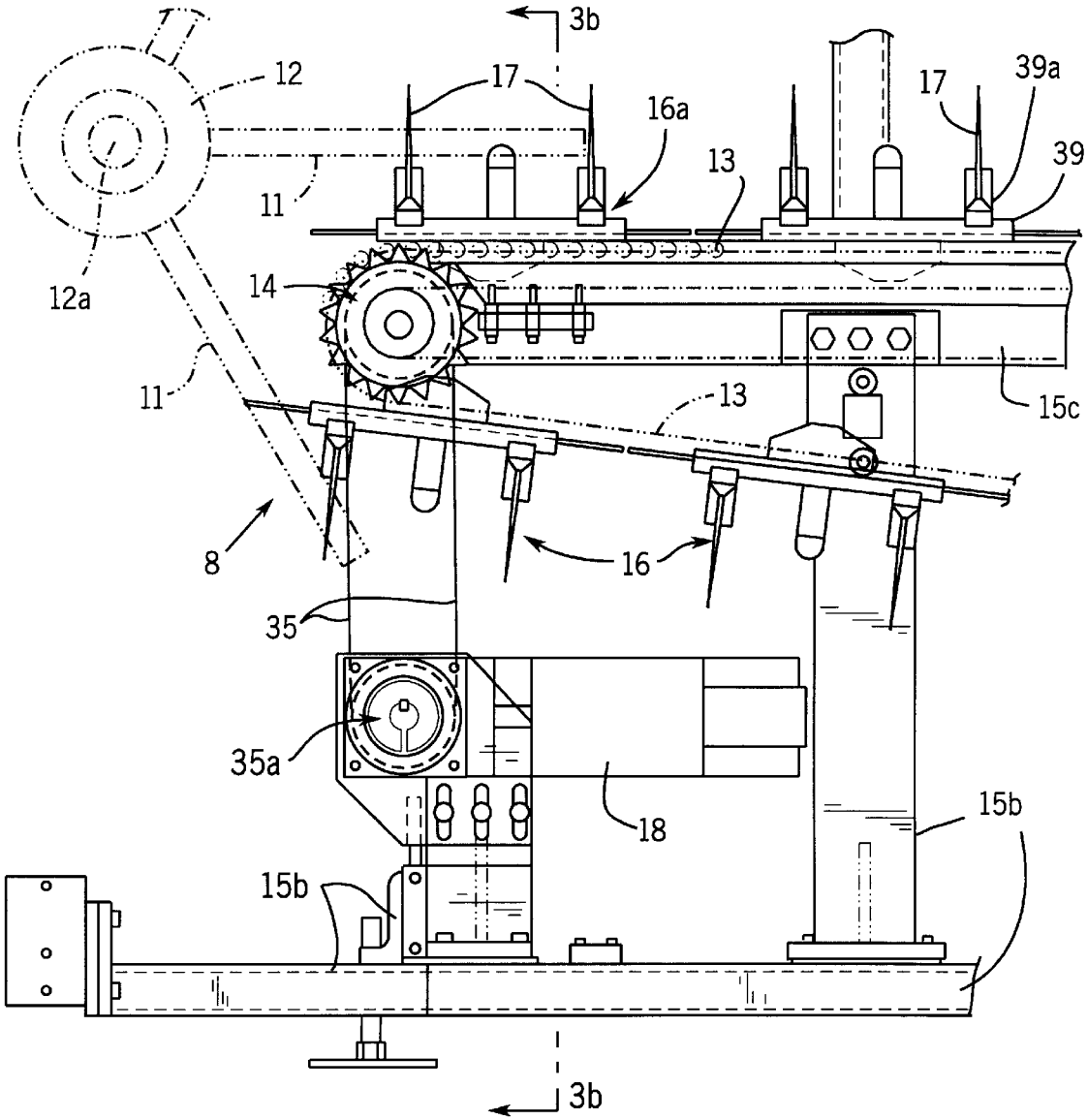
FIG. 3*a* is a fragmentary side view of a high response motor connected by an inelastic coupling to the wicket conveyor.
Figure 6A:
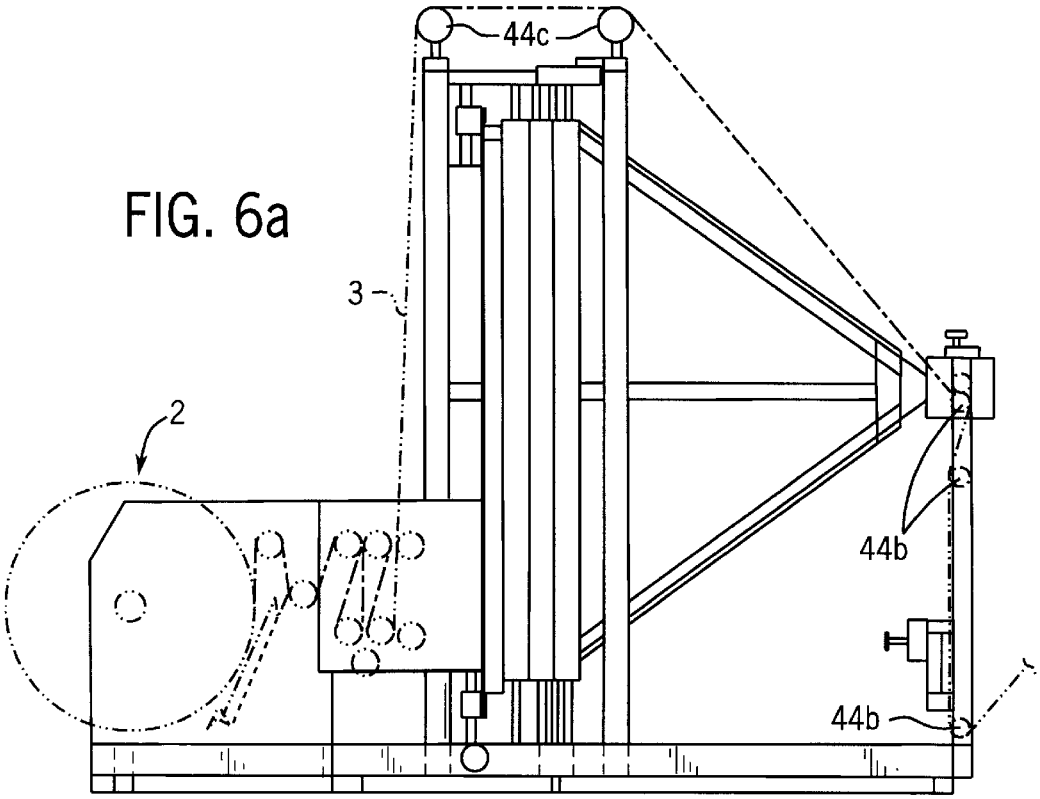
FIG. 6*a* illustrates a modified web supply unit.
Figure 3B:
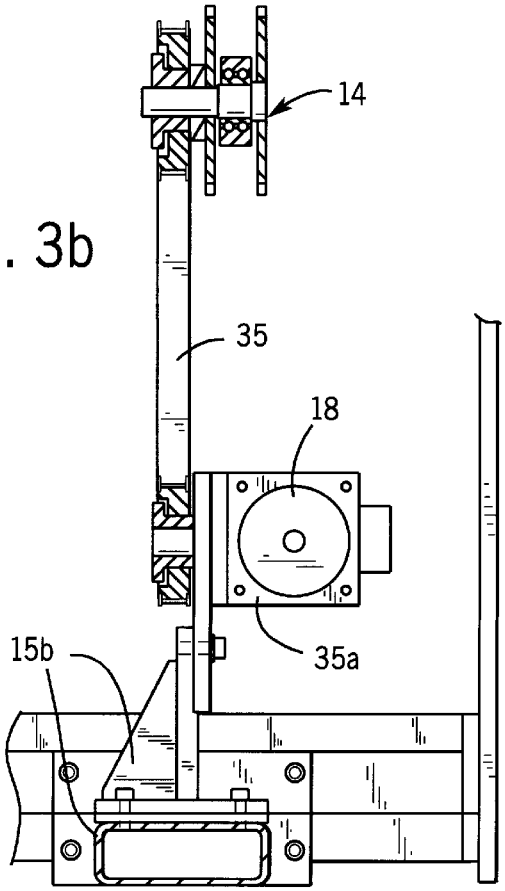
FIG. 3*b* is a vertical section taken generally on line 3*b*—3*b* of FIG. 3*a;*

The wicket conveyor, as illustrated generally in FIG. 1 and more fully disclosed in FIGS. 3–3*b*, is generally constructed in accordance with a known construction, with a continuous conveyor driven belt or chain 13, as an endless movable member, which is entrained about an input sprocket 14 and an output sprocket 15 as well as an intermediate guide sprocket 15*a*. The sprockets 14, 15 and 15*a* are spaced longitudinally to form an inline extension of the bag line. In the preferred construction of this invention, the movable member and the sprockets are mounted as a common drive unit in fixed relation to the conveyor support structure 15*b*. As most clearly shown in FIGS. 3*a* and 3*b*, the sprockets 14, 15 and 15*a* is secured to a beam member 15*c* which in turn is fixed to the vertical support members of structure 15*b*. The motor 18 and gear reducer are also mounted to the base support structure 15*b* and connected to the gear reducer and the sprocket 14, as hereinafter described.

A plurality of stacking elements or units, generally referred to as pin stackers 16, are secured in equi-spaced relation to the conveyor chain 13 in any suitable manner. The upper run includes a pin stacker 16*a* aligned with the discharge end of the path of the wicket arms 11 and thus the input end of the conveyor 8. As each arm 11 moves past the aligned pin stacker 16*a*, the bag 1 is deposited onto aligned pins 17 of the aligned stacker 16. Upon filling of the aligned pin stacker 16*a*, the conveyor is operated to move the filled pin stacker 16*a* downstream toward the output end, and move a trailing and empty pin stacker 16*b* into alignment at the receiving end.

Figure 2:
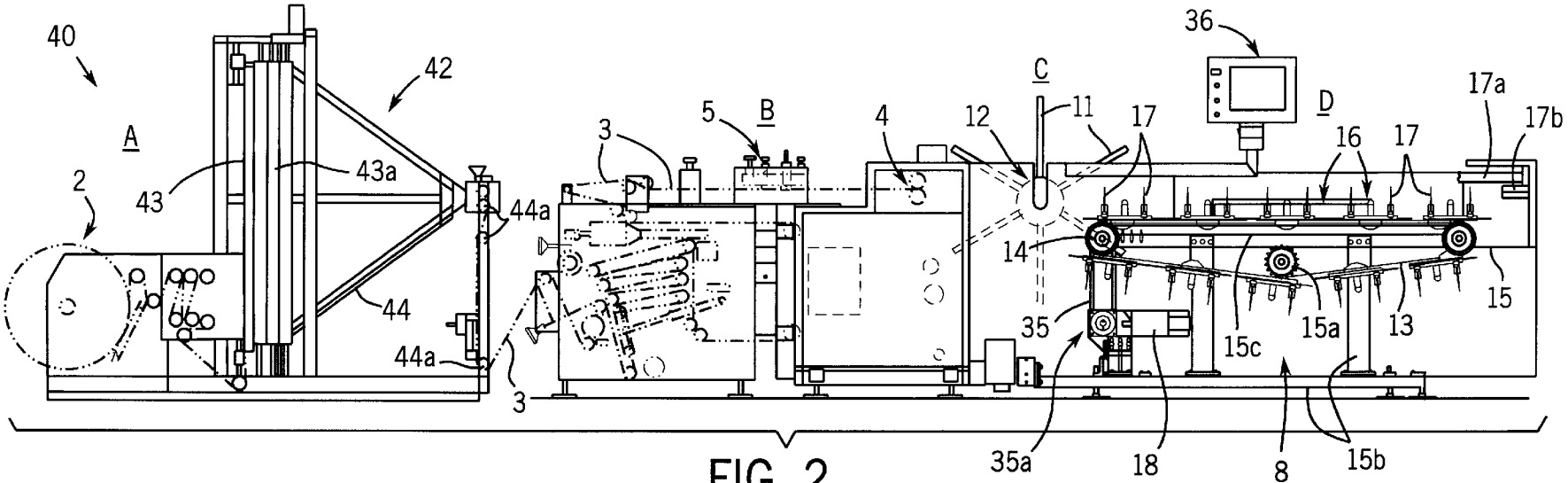
FIG. 2 is a side elevational view of a bag line.

As shown in FIGS. 2 and 3, a pivoting guard 17*a* is secured overlying the ends of the stacking pins 17. The guard is a beam member extended from the outer end of the conveyor and terminated in spaced relation to the stacker 16*a* at the input end. The guard 17*a* is latched in the overlying position to prevent engaging the sharp ends of the pins. A pivot support 17*b* attaches the outer end of the guard 17*a* to a post at the discharge end of conveyor 8. The guard 17*a* is pivotal for movement between the aligned position and in either direction and side of the conveyor 8, and therefore the bag line to allow the convenient unloading from either side of the conveyor.

A particular feature of the present invention is particularly directed to the drive and positioning of the wicket conveyor 8.

Referring to FIGS. 1–3 in the illustrated embodiment of the invention, the upstream or front sprocket 14 adjacent the input end of conveyor 8, is coupled to a high response motor 18, which is shown connected to provide an independent motor drive of the wicket conveyor. The motor 18 at the input end provides proper positioning in a rapid manner to minimize the delay or interrupt time required of the bag forming portion or machine of the line, as more fully developed hereinafter, and thereby permit high speed forming of bags.

The control system for the illustrated embodiment of the line includes a control system (FIG. 1) consisting of a first or main servo controller 21 which is a multi-axis controller for controlling of the punch unit 5, the draw rolls 4, the seal and cut unit 6 and the wicketer 7 of FIG. 1. The conveyor system is preferably controlled as an independent motor driven unit, generally as in the prior art, and is more fully described hereinafter in a preferred embodiment.

A main drive and timing shaft 19 forms a timing axis and is coupled to a cam unit 20 to move the cut and seal unit, shown in blade 10, in a stepped motion for severing of the forward end of web 3 to form bag la during the dwell period. The shaft 19 is driven through the multi-axis servo controller 21. The main servo drive thus includes a servo motor 22 coupled directly to the shaft 19 and operable to drive the shaft in a continuous manner during the operation of the bag forming line. A servo amplifier 22*a* provides power to energize the motor 22. An encoder 22*b* provides a feedback signal to the main servo controller 21 to establish the desired constant operation of the main timing shaft 19.

In addition, the timing shaft 19 is coupled through a mechanical connection shown by a dotted line 23 to actuate a separate encoder 24 which continuously drives a program limit switch 25 in accordance with the continuous rotating of shaft 19. The program limit switch 25 operates, as in the prior art, as a pulse signal source with the output applied to a counter 26, which in turn establishes a controlled timed operation of the various components of sections A, B, C and signal sections D, in accordance with past practice and more fully developed hereinafter as necessary to a clear understanding of the present invention.

The set of draw rolls 4, is provided with a separate servo drive system including a servo motor 27 coupled in a servo loop to the main servo controller 21. The servo motor 27 is coupled directly to rotate the draw roll 9. An amplifier 27*a* powers the motor in accordance with the output of the servo controller 21. An encoder 27*b* provides the feedback to the multi-axis servo controller 21. The servo motor 27 is energized in accordance and under control of the main servo controller 21. As previously described, the draw rolls 4 operate in a cyclical and interrupted manner to produce a web positioning period and a dwell period for each 360° and complete revolution of the shaft 19. During the positioning period, the cut and seal unit is stationary. During the dwell period of the draw rolls, the cut and seal unit is actuated to sever and seal the web.

The wicketer 7 includes a servo motor 28 coupled directly to the drive shaft 12*a* of the wicketer. The motor 28 is connected in a servo loop including a servo amplifier 28*a* connected to the main multi-axis controller 21 and an encoder 28*b* providing a feedback signal to the controller to establish and maintain the desired continuous operation of the wicketer 7 during the bag forming machine operation.

As noted previously, counter 26 is driven by the movement of the timing shaft 19 through the mechanical connected encoder 24 and the program limit switch 25, or through a cycle complete means within the controller 21 to send a series of pulses to the counter 26. The illustrated counter 26 includes a first count unit or register 29 which accumulates the number of machine cycles in accordance with the complete revolutions of the shaft 19 and the corresponding number of bags 1 formed. The register 29 is set to a preselected number of bags to be stacked on each stacker 16, and controls the operation of the draw rolls 4 and the cut and seal unit 6 to form that number of bags, and then creates a signal to the main servo controller 21 to stop the draw rolls 4 and provide an interrupt period to allow the indexing of the conveyor 8. The bags on the wicket arms 11 must be transferred to the stacker before the conveyor 8 can be operated. In the illustrated embodiment as shown in FIG. 1, the one arm 11 will be depositing a bag 1 onto the wicket conveyor 8. Three trailing arms will, at that time, carry bags 1. Those three bags must be transferred to the wicket conveyor 8 and form the complete stack. Thus, the register 29 will be set to respond at forming of the desired number of bags including the three on the arms. Such coincidence enables an interrupt count register 30 and an index count register 31. The interrupt count register 30 is preset to terminate the operation of the draw rolls for a predetermined number of cycles, related to the time required to move the wicket conveyor 8. Thus, it will terminate the forming of bags immediately and the next aligned arm or arms moves through the machine without a bag. The number of empty arms is related to the time required to move the conveyor 8 to align the next or trailing pin stacker 16 to receive a new stack of bags.

The index count register 31 is programmed to read a predetermined number of cycles equal to the number of arms required for moving of the remaining bags from the wicketer 7 to the wicket conveyor 8. The illustrated embodiment of the invention would include a count of three cycles corresponding to the movement of the three bags 1 to the existing stacker 16, at which time a signal is sent to enable the independent conveyor drive system and enable register 31. Register 31 is driven from the main timing encoder 24 and the program limit switch 25 or from the jam detector 32 mounted at the input end of the conveyor 8.

The jam detector 32 provides a pulse signal for each cycle and bag placement at the pin stacker 16*a*. The jam detector 32 thus constitutes a pulse generator of any suitable construction, responsive to the movement of the vacuum arms and/or the transfer of each bag 1 to the stacker 16*a*. The device may readily be a photocell sensor, an infrared sensor or any other similar device which will respond to movement and transfer of the vacuum arms and/or bags to produce a pulse signal for each transfer. In accordance with known operation, the jam detector 32 responds to a bag which is not properly dropped onto an aligned stacker. In such monitoring, the detector also provides a pulse signal for each vacuum arm movement with a bag properly deposited onto the pin stacker 16*a* and thus has been used to drive the register for starting the independent conveyor drive system or unit.

In the illustrated embodiment of the invention, the start signal is sent to a solid state relay 33, the output of which actuates a separate and independent servo controller 34 for operating of the response motor 18, which results in a compact conveyor drive system providing rapid and accurate positioning of the pin stackers with a simplified and compact conveyor line. The response motor 18 is connected to a gear reduction unit 35*a* generally identified as a gear reducer. The gear reducer 35*a* is connected by a suitable coupling unit 35, such as a timing belt or other similar device which produces an incompliant or inelastic connection to the sprocket 14. As a result, the conveyor movement is essentially in direct synchronism with the motor output. In the illustrated embodiment, the inelastic coupling unit 35 for the conveyor and pin stackers permits the fixed mounting of the conveyor chain unit in the support structure and the direct positioning of the pin stackers 16 in proper positioning for receiving of bags with the pins 17 and bag holes in proper alignment. Thus, the drive motor 18 can be operated in small movements to directly move the pin stackers about the input sprocket for fine tuning the proper position of the pin stackers. The servo controller 34 is programmed to drive the wicket conveyor 8 for a set period equal to that required to remove the aligned stacker 16*b* and align a new trailing pin stacker 16*c* into the receiving or loading station of the conveyor 8. The servo controller 34 includes a servo amplifier 34*a* connected to energize the motor 18 and an encoder 34*b* providing a feedback signal via line 34*c* to the servo controller 34 to provide the programmed operation of motor 18 and the conveyor 8. The servo controller 34 thus produces a programmed end movement of the conveyor 8 to align a new pin stacker 16*b* at the input end of the conveyor.

As shown in FIG. 1, a common touch screen unit 36 is illustrated for setting of the main servo controller 21 and separately setting the independent drive servo controller 34. The touch screen unit 36 has a bi-directional line 37 connected to the servo controller 21 and an unidirectional input line 38 to create a program select move connected to the servo controller 34 to set the same to a predetermined time for operating of the high response motor 18, as well as setting the home position of the conveyor and thereby the stacking elements.

The pin stackers 16 are preferably constructed with the pins 17 adjustably and removably mounted to the pin platforms 39 for proper location with respect to the pin platforms 39 for proper location with respect to the punched bag. An adjustable pin mounting is fully disclosed in the previously identified application wherein each pin 17 is removably mounted in its own slide 39*a* on the platform 39. Pins 17 can be arranged on a platform 39 for receiving one full bag, or two sets of pins provided to receive one-half size bags. Further, a double bag can be received by using two adjacent platforms 39 with a single pin 17 on each platform. The independent conveyor drive unit is thus particularly adapted to setting the conveyor chain unit and the pin stackers for receiving of the different sized bags.

In summary, the present invention provides a system using well known components which heretofore have been used in connection with the bag making machines and lines. The present invention, through the direct coupling of a high response motor 18 to the input end of the conveyor 8, provides for rapid transfer and movement of the conveyor. The separate servo controller 34 provides means for accurately setting and completing of the time period for conveyor movement and with rapid and constant movement of the conveyor 8 during each cycle, in accordance with the time setting transmitted via line 37*a*.

Although any suitable drive which provides the desired high speed coupling and with minimal tolerance within the drive can be provided. A preferred construction is more clearly shown in FIGS. 3, 3*a* and 3*b*.

The driven chain unit includes chain 13 with input sprocket 14 coupled to the motor 18. The output of the motor 18 includes the gear reducer 35*a* coupled by a timing belt 35 to the input sprocket 14. The motor is a high response motor which can rapidly accelerate the movement of the driven chain 13 of the wicket conveyor 8 to rapidly move the aligned stacker 16*a* and the following empty pin stacker 16*b* to the input end for receiving bags. This structure is a compact drive assembly which is readily located beneath the conveyor structure and provides a total compact conveyor part of the line. Present day AC servo motors provide sufficient high response characteristics for operating of the conveyor 8. In a preferred construction, the high response motor is an AC brushless servo motor. The assignee has used a motor manufactured by Indra-Mat of Germany. Other high response motors, such as AC vector motors, stepping motors and the like, can also be readily provided and used, with a separate servo controller providing the required timed indexed movement and home positioning of the wicket conveyor 8 as well as other control systems.

The independent servo controller 34 for the wicket conveyor 8 permits the operating personnel to also establish the small movement of the pin stackers 16 into proper receiving alignment. The touch screen 36 control and unidirectional input line 38 permits jogging of the motor 18 and movement of the pin stacker 16 with respect to the fixed mounting of the elongated movable member, shown as the chain 13, into the proper home positions and alignment to receive the bags 1 as the bags are moved rapidly to the conveyor 8 and aligned stacker 16*a*.

As previously discussed, the present invention also provides a more compact line. In this aspect of the invention, the line is formed with the supply section A including a web supply and folder unit 40 which further contributes to a minimized line length. A typical unit 40 for this section is shown in FIGS. 2 and S. The unit 40 has the web 3 from supply roll 2 passing through a tension control dancer assembly 41 and a vertically oriented V-folder unit 42 in-line with the bag line. The supply roll 2 is rotatably supported on an axis transverse to the bag line and offset to an outer side of the line, with the V-folder unit 42 including a web turn roll system or unit including a forty-five degree (45°) roller 43 and a set of vertical rollers 43*a* moving the web 3 into a vertical plane and into and over a vertical V-section 44 to fold the web 3 and pass the folded web over exit rollers 44*b* into the bag forming section B.

The illustrated supply unit is also adapted to direct feeding of web into the bag line by providing a guide and feed rolls 44*c*, above the turn roll unit and V-section 44 to move the web over the web turn unit and into the exit rollers 44*b*. The direct guide and feed rollers 44*c* system may also be located beneath the turn roll system and folder unit. Alternatively, the V-folder unit 42 may be movable mounted by a slide on the shown base support for lateral movement from alignment with the supply roll and thereby permitting direct movement of the web into the bag forming portion of the line.

Figure 5:
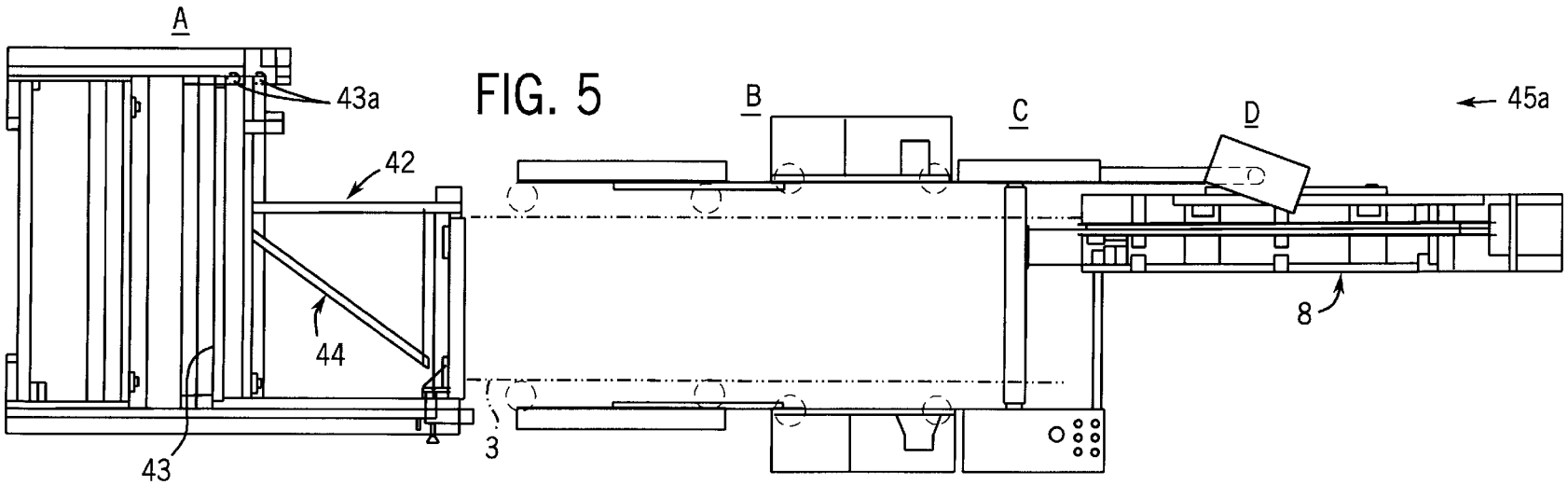
FIG. 4 is an end view and FIG. 5*a* is a top view of FIG. 2.

With supply roll 2 extended to the one side of the bag machine, as shown in FIG. 5, a space 45*a* is formed to the one side of the bag line, within which a control component panel or cabinet 45 is conveniently located. The controllers including the amplifiers, the programmable switch and the like are housed in the cabinet 45 and connected by a cable 46, partially shown in phantom, to the drive system including the motors, encoders and sensors, and other operating components. The cable 46 is passed through a cable duct 47 secured between the cabinet 45 and the bag forming machine.

Figure 4:
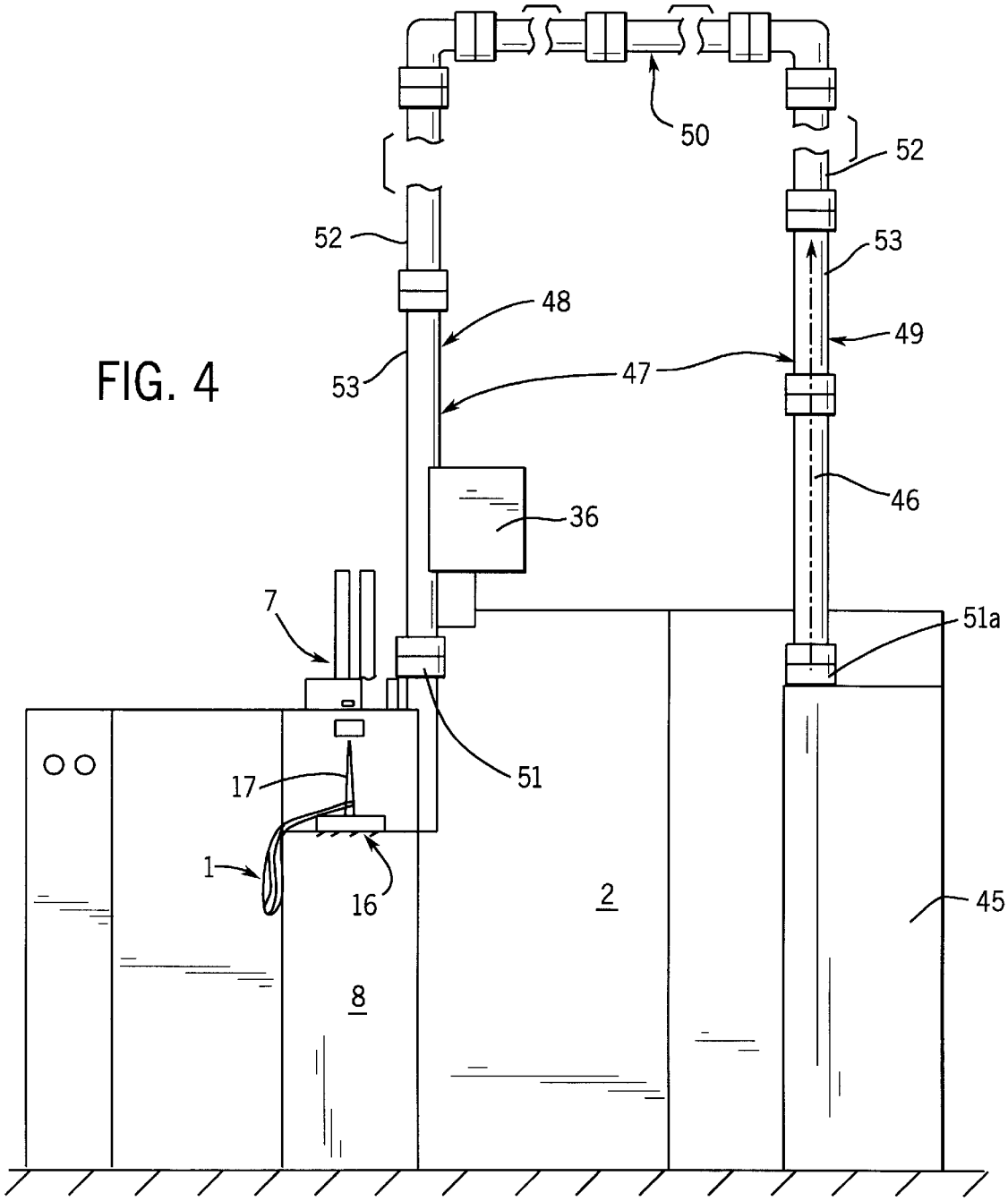

In a commercial bag line, the control component panel or cabinet 45 is movably mounted for optimal positioning with respect to the bag machine and generally has been positioned in the area of the control station adjacent the conveyors. In the compact unit as disclosed herein in FIGS. 3–5, the component panel or cabinet 45 is conveniently located within the supply roll assembly and in laterally spaced relation to the V-folder section. The movable cabinet 45 does not include any controls as such but rather the controlled components, such as the servo controllers, control registers, amplifiers and connecting circuits, and the like. The several components are coupled through the cable duct 47 to the various controls and sensing systems including the touch-screen, sensors, and the like, coupled to the bag line components as such.

The cable duct 47 is generally an upstanding U-shaped member (FIGS. 4 and 5) with one vertical leg 48 secured to the bag machine and the second vertical leg 49 secured to the cabinet 45 and interconnected by a raised cross arm or leg 50. A pivot connector 51 and 51*a* (FIGS. 4 and 5) are provided within the vertical legs 48 and 49. The connector 51 permits the pivoting of the duct 47 about the axis of the leg 48 and various orientations of the cabinet relative to the bag making machine. The second connections permits rotation of the cabinet 45. In addition, each of the vertical legs 48 and 49 include various length sections 52 and 53 interconnected to each to form the elongated legs. The legs can therefore be made longer or shorter to accommodate various installations. In addition, the length of the horizontal leg 50 may be varied to reposition the cabinet 45.

The bag forming line, as disclosed, is also particularly adapted for multiple line installations where the floor space requirements are significant because of cost and available existing floor space.

Referring to FIG. 7, a multiple line bag forming assembly is illustrated including four duplicate lines 54, 54*a*, 54*b* and 54*c*, each of which is shown diagrammatically and located in side-by-side aligned relation. The structures for forming the bags from the film, the wicket and the conveyor are preferably structures as heretofore described with dual lateral unloading from the conveyor.

The lines 54 through and 54*c* are identically formed and are spaced laterally to define a working space or aisle between the adjacent lines, particularly between sections B through D. The line 54 is described in detail and the corresponding elements and structure of the other lines are identified by corresponding primed numbers.

Line 54 includes a L-shaped web supply V-folder unit 55 for supplying a folded web 56 for processing into bags stacked at the in-line conveyor 57.

Line 54 is unloaded from the inside of the conveyor 57 while the adjacent line 54*a* is unloaded from the outside of the conveyor 57'. The area 58 between the conveyor 57 and 57' form an enlarged unloading spaced or aisle, as a result of the offset of the conveyors 57 and 57', as a result of the supply unit structure and the conveyors which are unloaded from either side. The spacing between the supply units and the bag machines is minimized, as at 59 and 59*a*.

The supply rolls 60 and 60' are introduced to the respective lines from the outer aisle 61 which extends past the outer end of the lines.

In a commercial structure with two lines, an assembly has had a footprint of substantially 340 inches long and 195 inches wide. The aisle width between the supply unit was substantially 25 inches and between the bag forming and wicket structure was substantially 50 inches and the width between inside and outside of the respective adjacent conveyors was substantially 85 inches. No side loading area is required between the rolls because loading is from the end aisle.

In the four line system, lines 54*b* and 54*c* are similarly mounted immediately adjacent the lines 54 and 54*a*.

Further, a typical unload involves personnel manually grasping the bag stack and lifting them from the pins and placing them in a box. A system may be provided to transfer the bag stack to a corresponding arranged V-shaped pin unit for receiving the pin stack, placing a separator thereon and placing another bag stack thereon and continuing to fill a full pin unit. Alternatively, the bag stacks may be placed on proper sized boxes.

Although the above specific example is not limiting, it discloses the multiple line system having a substantially reduced footprint than generally available with prior art systems.

The illustrated embodiment of the present invention provides a cost effective high speed wicket conveyor permitting the rapid formation and operation of the total line and may readily require a single bag forming cycle for indexing of the conveyor. In addition, the conveyor is a compact unit as a result of the eliminating of the large end drive assembly as used in the prior art and the use of the high response motor at the input end of the conveyor.

Various modes of carrying out the invention are contemplated as being within the scope of the following claims particularly pointing out and distinctly claiming the subject matter which is regarded as the invention.

I claim:

1. A bag making apparatus, comprising bag forming means for forming successive bags from a web, transfer means for transferring said bags in sequence, stacking means for receiving said bags from said transfer means and stacking said bags in predetermined stacks of bags, said stacking means including a wicket conveyor including a plurality of pin stackers secured in spaced relation to a movable endless member having an input end and an output end, means for moving said endless movable members and said pin stackers in sequence between said input end and said output end, and said means for moving including a high response motor means spaced from the input end of said wicket conveyor, and an interconnecting mechanism connected to said motor means and to said input end of said wicket conveyor for rapidly and accurately moving the pin stackers into the stacking position creating a compact wicket conveyor.

2. The bag making apparatus of claim 1 wherein said high response motor means is a servo motor, and including an independent servo controller means for energizing said servo motor, means responsive to forming a selected stack of bags on a pin stacker to send a start signal to said servo controller.

3. The bag making apparatus of claim 2 including a unidirectional input control to said independent servo controller for establishing a preset cycle for moving said conveyor.

4. The bag making apparatus of claim 1 wherein said movable endless member is a chain-like member supported at the input end by a rotating input sprocket and at the output end by a rotating output sprocket, said high response motor means includes a servo motor, and including an inelastic coupling unit connecting said servo motor to said input sprocket.

5. The bag making apparatus of claim 4 wherein said servo motor is located beneath and substantially aligned with said input sprocket.

6. The bag making apparatus of claim 4 including a gear reducer connected to said servo motor, and said elastic coupling unit being connected to said gear reducer.

7. The bag making apparatus of claim 1 including a web supply unit for supporting a web roll with a horizontal axis of rotation and a V-folder for folding the web, said V-folder being vertically oriented and including a turn roll assembly for receiving the horizontal web and turning the web into a vertical plane for folding movement over said V-folder to fold the web.

8.The bag making apparatus of claim 7 wherein said web supply unit includes means to supply said web from the web roll directly to the bag forming means.

9. The bag making apparatus of claim 1 including a plastic web supply means and wherein said means for forming bags includes a draw roll means having an input side drawing a plastic web from said supply means under tension, means mounted immediately downstream of said draw roll means for selectively and periodically severing said web from said draw roll means to sequentially form the plastic bags and for transferring said bags to said transfer means, said transfer means including a wicketer including a plurality of rotating arms for supporting and carrying of individual bags in sequence to a discharge end, and said input end of said wicket conveyor aligned with said discharge end.

10. The bag making apparatus of claim 9 wherein said endless movable member is an endless belt with an upper run and a lower run secured about an input end sprocket and a discharge end sprocket, said plurality of pin stackers secured to said endless belt on both the upper and lower runs, said high response motor means is connected to said input sprocket and providing direct drive of said sprocket and endless belt, and a drive control system is connected to operate said draw rolls and said high response motor and provide a predetermined cyclical timing for forming of said bags and an interrupt period and moving said endless belt a preset period after said interrupt period.

11. The bag making apparatus of claim 10 wherein said high response motor means includes an AC servo motor, said drive control system includes an independent servo controller having a programmable input for energizing said AC servo motor for a programmed index movement of the conveyor and having a start signal means responsive to the system cycles placing said bags on said pin stacker.

12. The bag making apparatus of claim 11 wherein said start signal is created in synchronism with the bags on said wicketer to provide for transfer of said bags to the pin stacker at said input end to form a filled stack of bags, said control system includes a plurality of registers for storing signals related to said cycles of said system, including a first register, a second register and a third register, pulse generator means responsive to the cyclical forming and movement of said bags and connected to said first register for recording each cycle and for enabling said second and third registers upon forming a selected number of bags corresponding to a filled stack, detector means coupled to said discharge end of said wicket transfer unit and said input end of said conveyor and operable to generate a pulse for each cycle and transfer of a bag to said stacker, and means to selectively connect said third register to said detector means or said pulse generating means for sending a start signal to said independent servo controller operating said high response motor.

13. The bag making apparatus of claim 10 including a multi-axis servo controller controlling said means for forming bags and said wicketer, said multi-axis servo controller including means responsive to forming a predetermined number of bags to terminate movement of said web and enable a signal means to count each bag forming cycle and respond to the number of cycles required to move bags on said transfer unit to said wicket conveyor, and said signal means connected to means for starting operation of said independent servo controller for said conveyor.

14. The bag making apparatus of claim 13 wherein said signal means to count includes a first register operable to enable an interrupt register and provide an output signal to terminate operation of said bag forming means for a predetermined number of cycles, and a second register connected to said means for starting said independent servo controller.

15. The bag making apparatus of claim 1 wherein said high response motor unit is an induction motor in combination with a vector drive.

16. A plastic bag making apparatus comprising a web supply section including web supply means supporting a roll of a plastic web and a V-folder mounted in a vertical orientation and a roll turning unit for guiding the web from the roll to the V-folder, a bag forming section having draw roll means coupled to said web and operable to draw said web from said supply unit for forming successive bags from said web, a transfer section including a wicketer for receiving each said bag in sequence and having rotating arms for receiving and carrying each bag to a discharge end of said wicketer, a conveyor section mounted adjacent the discharge end of said wicketer, said conveyor section including a conveyor support structure, a movable endless belt including spaced rotatable input and output sprockets at the opposite ends of said belt and defining an upper run and a lower run between said input end aligned with the wicketer and an output end spaced therefrom, said support structure includes a fixed beam and said input sprocket secured to said beam in fixed relation to said wicketer, a plurality of equi-spaced pin stackers secured in equi-spaced relation to said belt, said rotatable input sprocket at said input end being precisely located with respect to the wicketer for receiving of said bags, a high response motor having a gear reducer and being connected to said input end, an inelastic belt connecting said gear reducer unit to said input sprocket for moving of said endless belt and positioning of a pin stacker in alignment with the discharge end of the wicketer, and a servo controller connected to operate said high response motor for precise controlled positioning of said stacker relative to the input end of the endless member and thereby establishing a home position of said stacker, and said servo controller operating said motor to move the endless belt in predetermined steps to remove a filled pin stacker and precisely locating a trailing empty pin stacker in said home position.

17. The apparatus of claim 16 wherein said motor and gear reducer are secured to said support structure with the gear reducer having an output member in substantial vertical alignment with said input sprocket and said inelastic belt in substantially vertically oriented alignment adjacent the input end of said conveyor.

18. The apparatus of claim 17 wherein said endless belt is a chain having said platforms firmly affixed to said chain and said inelastic belt is a timing belt.

19. The apparatus of claim 18 including an independent servo controller including a servo loop connected to said high response motor, a touch screen control, a unidirectional line connected to said screen and said servo controller and providing for manually controlled movement of said motor for locating a pin stacker in a home position relative to said wicketer and for setting said servo controller for a selected movement of said endless belt for removing a pin stacker from said home position and simultaneously moving a trailing pin stacker into said home position in response to a start signal to said controller.

20. The apparatus of claim 16 wherein said pin stackers each including a corresponding correspondence and each includes a platform secured to the belt, each said stacker including pins adjustably mounted on said platform for adjusting the pin spacing in accordance with therewith of the bag, each platform of length to include up to four pins for receiving of bags of one full length bag or two half length bags and wherein adjacent platforms can be aligned with the wicketer, and with each platform having a single pin to accept bags of a double length, said wicketer having vacuum for supporting the bags in accordance with the spacement of the pins of said stacking elements.

21. A multiple line bag making apparatus having a minimal footprint, comprising at least two parallel compact bag lines of the same components aligned in side-by-side relation, each of said parallel bag lines having a generally L-shape comprising a web supply section having an L-shape supply and including a rotatable web supply roll unit forming a long leg of the section and having an axis of rotation transverse to the line and a V-folder adjacent the rotatable web supply roll unit forming a second short leg of the supply sections, a bag forming section aligned with the V-folder and extending therefrom, a wicketer aligned with the bag forming section and extending therefrom, a wicket conveyor having an input end adjacent the wicketer and extending from the wicketer, said wicket conveyor being unloaded from either side of the conveyor, said aligned web supply sections being located in closed spaced relations, forming an enlarged unload section between said aligned wicketer conveyors a component cabinet housing control components for said sections, said cabinet being located within the L-shape portion of the web supply section, a U-shaped cable duct having first and second vertical legs connected to the bag forming section and the component cabinet and a horizontal leg connecting said vertical legs and a cable in said duct connecting the control components to said sections for operation of said sections.

22. The apparatus of claim 21 wherein said wicket conveyor includes a drive motor unit located adjacent and connected to the end of the conveyor adjacent the wicketer.

* * * * *

UNITED STATES PATENT AND TRADEMARK OFFICE

CERTIFICATE OF CORRECTION

PATENT NO : 6,004,252

DATED : December 21, 1999

INVENTOR(S) : GILES R. BLASER

It is certified that error appears in the above-identified patent and that said Letters Patent is hereby corrected as shown below:

In The Claims

CLAIM 20, Col. 16, line 8, Delete "therewith" and substitute therefor --the width--;

Signed and Sealed this

Thirteenth Day of March, 2001

*Attest:*

Nicholas P. Godici

NICHOLAS P. GODICI

*Attesting Officer*

*Acting Director of the United States Patent and Trademark Office*